US005450636A

United States Patent [19]

Graeber

[11] Patent Number: 5,450,636

[45] Date of Patent: Sep. 19, 1995

[54] HAIR CLEANING APPARATUS FOR INVALIDS

[76] Inventor: Gloria J. Graeber, Shine Hill Rd. Box 439 R.D.#1, Henryville, Pa. 18332

[21] Appl. No.: 314,100

[22] Filed: Sep. 28, 1994

[51] Int. Cl.[6] ..... A45D 44/08

[52] U.S. Cl. ..... 4/520

[58] Field of Search ..... 4/515–523

[56] References Cited

U.S. PATENT DOCUMENTS

| | | | |
|---|---|---|---|
| 1,223,263 | 4/1917 | Day | 4/520 |
| 2,475,259 | 7/1949 | Singleton | 4/515 |
| 2,818,585 | 1/1958 | Campbell | 4/522 X |
| 3,046,567 | 7/1962 | Jackson | 4/520 X |
| 3,816,858 | 6/1974 | Martin | 4/515 |

*Primary Examiner*—Charles E. Phillips

[57] ABSTRACT

A hair cleaning apparatus for invalids comprising an essentially rigid drain plate which has side edges and upper and lower edges. The drain plate has an upper surface and a lower surface with the upper surface formed with longitudinal recesses spaced along the upper surface thereof. A first upper tube is coupled to the upper edge. The first tube is adapted to support the neck of a user. A second lower tube is hollow and adapted to receive a quantity of water from the upper surface of the plate. The second tube has an end cap with a closure adapted to retain the drain water therein when in the operative position. A hollow transition manifold is coupled between the plate and the second lower tube. The manifold has a lower imperforate surface and an upper surface with drain holes to receive the water from the upper surface of the drain plate. The holes are in fluid communication with the space between the upper and lower surfaces of the manifold. The manifold is coupled at its upper end to the drain plate with its lower end coupled and in fluid communication with the second lower tube.

4 Claims, 4 Drawing Sheets

HAIR CLEANING APPARATUS FOR INVALIDS

BACKGROUND OF THE INVENTION

1. Field of the Invention

The present invention relates to hair cleaning apparatus for invalids and more particularly pertains to allowing the washing, shampooing and rinsing of hair of an invalid while lying down.

2. Description of the Prior Art

The use of devices of various designs and constructions for washing hair of patrons and for facilitating the comfort of invalids is known in the prior art. More specifically, devices of various designs and constructions for washing hair of patrons and for facilitating the comfort of invalids heretofore devised and utilized for the purpose of making invalids more comfortable through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 296,482 to LaCour discloses a hair washing tray.

U.S. Pat. No. Des. 309,801 to Arneson discloses a child's hair washing support.

U.S. Pat. No. 3,465,370 to Chernick discloses a hair washing tray for bed patients.

U.S. Pat. No. 3,816,858 to Martin discloses an inflatable hair washing aid.

Lastly, U.S. Pat. No. 5,022,102 to Louvaris discloses an inflatable bathing device.

In this respect, the hair cleaning apparatus for invalids according to the present invention substantially departs from the conventional concepts and designs of the prior art, and in doing so provides an apparatus primarily developed for the purpose of allowing the washing, shampooing and rinsing of hair of an invalid while lying down.

Therefore, it can be appreciated that there exists a continuing need for new and improved hair cleaning apparatus for invalids which can be used for allowing the washing, shampooing and rinsing of hair of an invalid while lying down. In this regard, the present invention substantially fulfills this need.

SUMMARY OF THE INVENTION

In view of the foregoing disadvantages inherent in the known types of devices of various designs and constructions for washing hair of patrons and for facilitating the comfort of invalids now present in the prior art, the present invention provides an improved hair cleaning apparatus for invalids. As such, the general purpose of the present invention, which will be described subsequently in greater detail, is to provide a new and improved hair cleaning apparatus for invalids and method which has all the advantages of the prior art and none of the disadvantages.

To attain this, the present invention essentially comprises a new and improved hair cleaning apparatus for invalids comprising, in combination, an essentially rigid drain plate which has parallel side edges and a parallel upper and lower edge. The drain plate has an upper surface and a lower surface with the upper surface formed with longitudinal recesses spaced along the upper surface thereof parallel with the side edges. A first upper tube is coupled to the upper edge. The first tube is adapted to support the neck of a user. The first tube is formed with a valve in one end with a stopper adapted to be used for the inflation of the first tube for the comfort of the neck of a user when resting thereon. A second lower tube is of a diameter greater than the diameter of the first upper tube. The second lower tube is hollow and adapted to receive a quantity of water from the upper surface of the plate. The second tube has an end cap with a two-way valve adapted to retain the drain water therein when in the operative position. The plug is adapted to be removed for the removal of the drain water therefrom. Further included is a hollow transition manifold which is coupled between the plate and the second lower tube. The manifold has a lower imperforate surface and an upper surface with drain holes to receive the water from the upper surface of the drain plate. The holes are in fluid communication with the space between the upper and lower surfaces of the manifold. The manifold couples at its upper end to the drain plate with its lower end coupled and in fluid communication with the second lower tube.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair cleaning apparatus for invalids which have all the advantages of the prior art devices of various designs and constructions for washing hair of patrons and for facilitating the comfort of invalids and none of the disadvantages.

It is another object of the present invention to provide new and a improved hair cleaning apparatus for invalids which may be easily and efficiently manufactured and marketed.

It is further object of the present invention to provide a new and improved hair cleaning apparatus for invalids which is of durable and reliable constructions.

An even further object of the present invention is to provide a new and improved hair cleaning apparatus for invalids which is susceptible of a low cost of manufacture with regard to both materials and labor, and which accordingly are then susceptible of low prices of sale to the consuming public, thereby making such hair cleaning apparatus for invalids economically available to the buying public.

Still yet another object of the present invention is to provide a new and improved hair cleaning apparatus for invalids which provides in the apparatuses and methods of the prior art some of the advantages thereof, while simultaneously overcoming some of the disadvantages normally associated therewith.

Even still another object of the present invention is to allow the washing, shampooing and rinsing of hair of an invalid while lying down.

Lastly, it is an object of the present invention to provide a new and improved hair cleaning apparatus for invalids comprising an essentially rigid drain plate which has side edges and upper and lower edges. The drain plate has an upper surface and a lower surface with the upper surface formed with longitudinal recesses spaced along the upper surface thereof. A first upper tube is coupled to the upper edge. The first tube is adapted to support the neck of a user. A second lower tube is hollow and adapted to receive a quantity of water from the upper surface of the plate. The second tube has an end cap with a closure adapted to retain the drain water therein when in the operative position. A hollow transition manifold is coupled between the plate and the second lower tube. The manifold has a lower imperforate surface and an upper surface with drain holes to receive the water from the upper surface of the drain plate. The holes are in fluid communication with the space between the upper and lower surfaces of the manifold. The manifold is coupled at its upper end to the drain plate with its lower end coupled and in fluid communication with the second lower tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
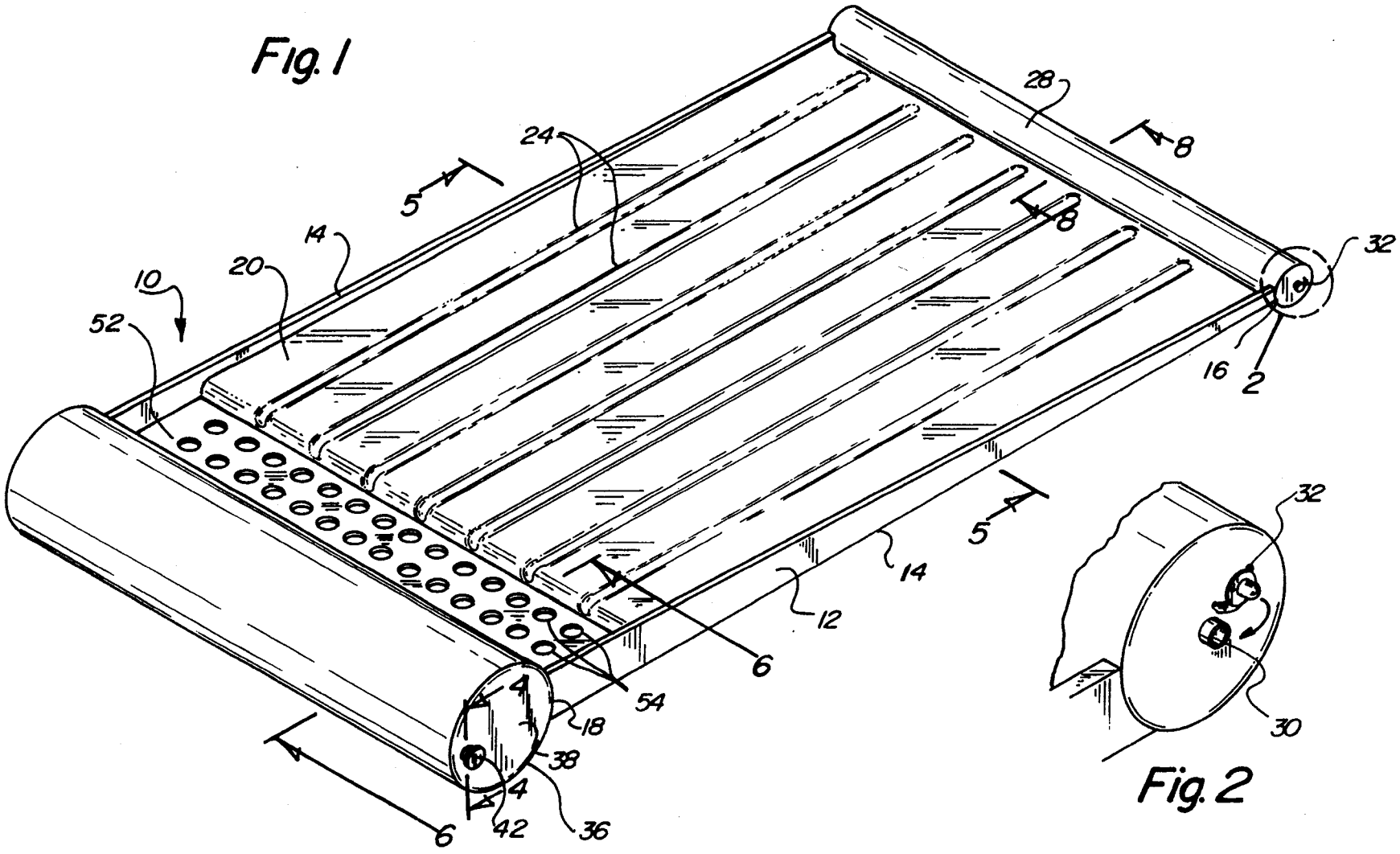
FIG. 1 is a perspective view of the preferred embodiment of the new and improved hair cleaning apparatus for invalids constructed in accordance with the principles of the present invention.
FIG. 2 is an enlarged perspective viewing of the upper end of the device taken along circle two of FIG. 1.
Figure 3:
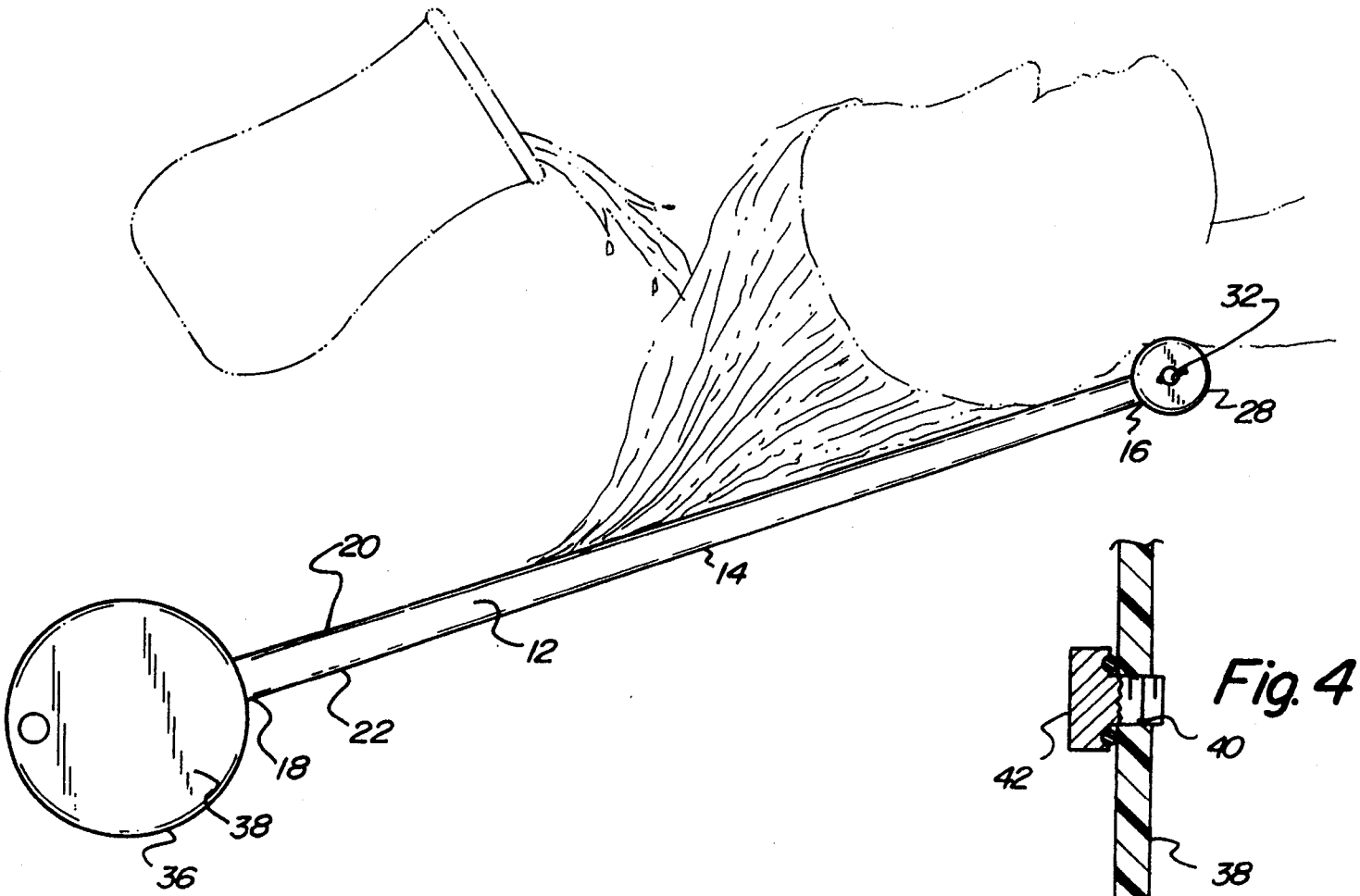
FIG. 3 is a side elevational view of the device during operation and use.
Figure 4:
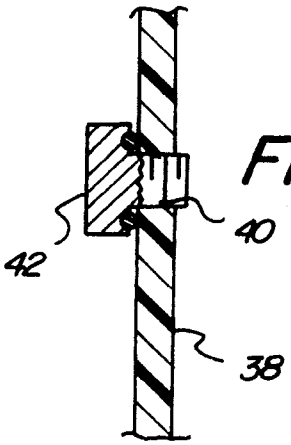
FIG. 4 is a cross sectional view taken along line 4—4 of FIG. 1.
Figure 5:
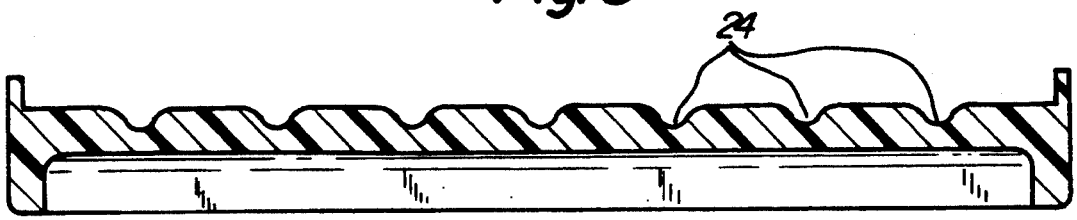
FIG. 5 is a cross sectional view taken along line 5—5 of FIG. 1.
Figure 6:
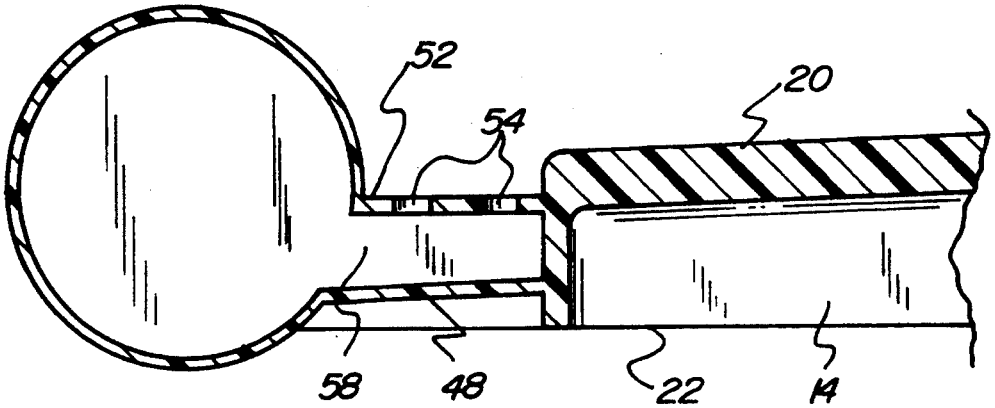
FIG. 6 is a cross sectional view taken along line 6—6 of FIG. 1.
Figure 7:
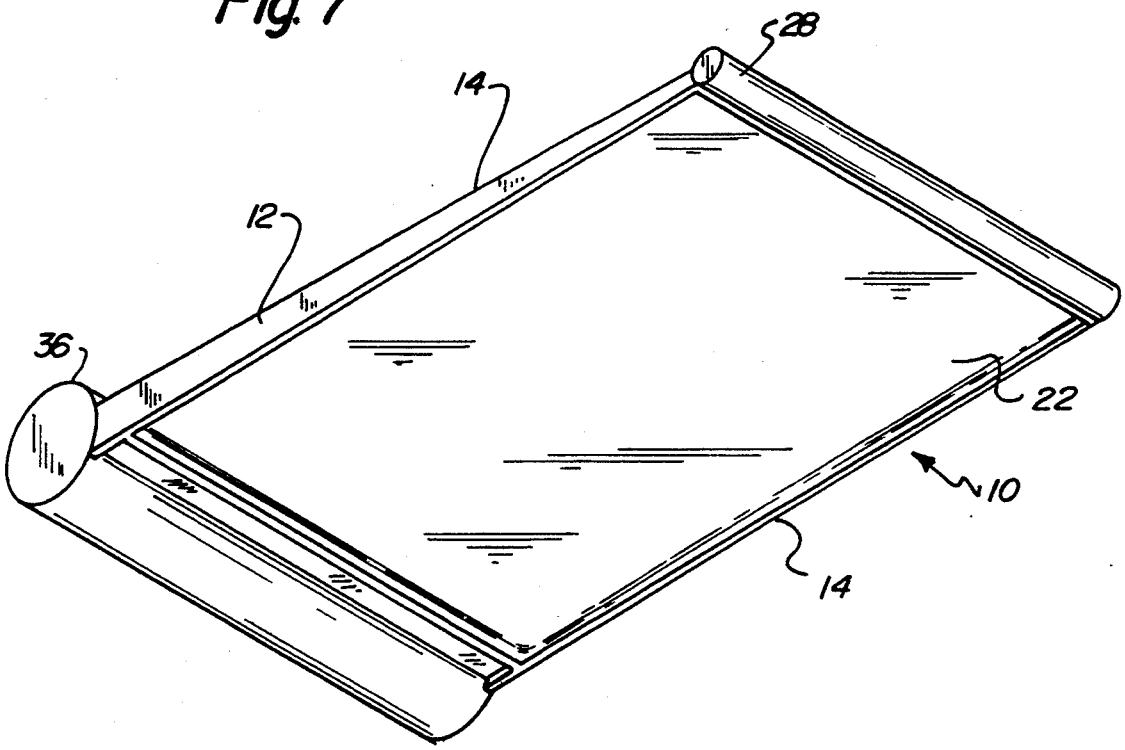
FIG. 7 is a perspective view of the rear surface of the device of FIG. 1.
Figure 8:
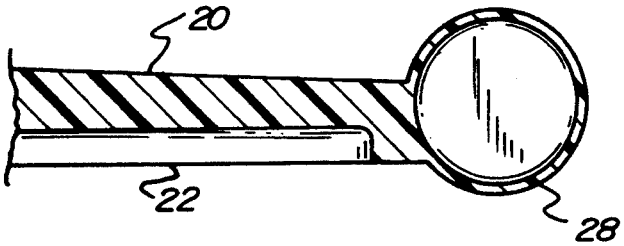
FIG. 8 is a cross sectional view taken along line 8—8 of FIG. 1.

With reference now to the drawings, and in particular to FIG. 1 thereof, the preferred embodiment of the new and improved hair cleaning apparatus for invalids embodying the principles and concepts of the present invention and generally designated by the reference numeral 10 will be described.

The present invention, the new and improved hair cleaning apparatus for invalids is comprised of a plurality of components. Such components in their broadest context include a drain plate, an upper tube, a lower tube and a hollow transition manifold therebetween. Such components are individually configured and correlated with respect to each other so as to attain the desired objective.

The central component of the system 10 of the present invention is an essentially rigid drain plate 12. The drain plate has parallel side edges 14 and parallel upper and lower edges 16, 18. The drain plate also has an upper surface 20 and a lower surface 22. The upper surface is formed with longitudinal recesses 24. Such recesses are spaced along the upper surface of the drain plate. They are parallel with the side edges.

The next component of the system 10 is a first or upper tube 28. Such upper tube is coupled to the upper edge of the drain plate. Such upper tube is adapted to support the neck of a user. Such first tube is formed with a valve 30 in one end with a stopper 32. The valve is adapted to be used for inflation and deflation of the first tube. The stopper is adapted to maintain the inflation air within the tube. This is to suit the comfort of the neck of a user when resting thereon.

The next component of the system 10 is a second or lower tube 36. Such second tube, like the first tube, has a circular cross sectional configuration. The diameter of the lower tube is greater than the diameter of the upper tube. The lower tube is hollow. It is adapted to receive a quantity of water from the upper surface of the drain plate. The second tube has an end cap 38. Within the end cap is a two-way valve 40. Such two-way valve is adapted to retain the drain water therein when in the operative position. The plug 42 of the valve is adapted to be removed for the removal of drain water therefrom after use.

The last major component of the system 10 is a hollow transition manifold 46. The manifold is coupled between the drain plate and the second or lower tube. The manifold has a lower imperforate surface 48. It also has an upper surface 52. The upper surface is formed with drain holes 54 therethrough. The drain holes are formed radially and are adapted to receive water from the upper surface of the drain plate.

The drain holes are in fluid communication with the space 58 between the upper and lower surfaces of the manifold. The manifold is coupled at its upper end to the drain plate. Its lower end is coupled and in fluid communication with the second or lower tube.

The present invention allows the hair to be washed, shampooed and rinsed while lying down. This can be done with a minimum disturbance to the patient and without soiling the bed. With this invention, the hair is washed just as effectively as if it were over a sink. Effective hair washing and grooming is not only healthy and sanitary, but it also boosts the morale of the patients and their families. This convenient pad is suitable for use in the home, hospitals, nursing homes and similar facilities. It reverses a task which is ordinarily a messy job into a simple procedure. Understandably, the patients are happier, more comfortable, and the attendants no longer find the task to be distasteful.

The pad is made of plastic with a rectangular shape which has three sections. At one end is a cervical pillow which supports the patient's neck very comfortably and allows the head to be raised slightly for washing and rinsing, with a minimum of effort from the attendant. Above the pillow is a pan, with contoured grooves and gutters to carry the water down into a large storage tank which holds approximately one gallon. The head and hair rest in the pan while the hair is being washed. A spout is provided at the end of the tank to extract the water.

The present invention can be molded from foam material, or it can be inflatable. The latter method allows it to be deflated for storage in a much smaller space. This is a one size fits all device, suitable for everyone, ranging from small children to large adults.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair cleaning apparatus for invalids comprising:

an essentially rigid drain plate having side edges and upper and lower edges, the drain plate having an upper surface and a lower surface with the upper surface formed with longitudinal recesses spaced along the upper surface thereof;

a first upper tube coupled to the upper edge, the first tube being adapted to support the neck of a user;

a second lower tube being hollow and adapted to receive a quantity of water from the upper surface of the plate, the second tube having an end cap with a closure adapted to retain the drain water therein when in the operative position; and a hollow transition manifold coupled between the plate and the second lower tube, the manifold having a lower imperforate surface and an upper surface with drain holes to receive the water from the upper surface of the drain plate, the holes being in fluid communication with the space between the upper and lower surfaces of the manifold, the manifold coupled at its upper end to the drain plate with its lower end coupled and in fluid communication with the second lower tube.

2. The apparatus as set forth in claim 1 wherein the lower tube is of a diameter greater than the diameter of the upper tube.

3. The apparatus as set forth in claim 1 wherein the first tube is formed with a valve in one end with a stopper adapted to be used for the inflation of the first tube for the comfort of the neck of a user when resting thereon.

4. A new and improved hair cleaning apparatus for invalids comprising, in combination:

an essentially rigid drain plate having parallel side edges and a parallel upper and lower edge, the drain plate having an upper surface and a lower surface with the upper surface formed with longitudinal recesses spaced along the upper surface thereof parallel with the side edges;

a first upper tube coupled to the upper edge, the first tube being adapted to support the neck of a user, the first tube being formed with a valve in one end with a stopper adapted to be used for the inflation of the first tube for the comfort of the neck of a user when resting thereon;

a second lower tube of a diameter greater than the diameter of the first upper tube, the second lower tube being hollow and adapted to receive a quantity of water from the upper surface of the plate, the second tube having an end cap with a two-way valve adapted to retain the drain water therein when in the operative position, the plug adapted to be removed for the removal of the drain water therefrom; and a hollow transition manifold coupled between the plate and the second lower tube, the manifold having a lower imperforate surface and an upper surface with drain holes to receive the water from the upper surface of the drain plate, the holes being in fluid communication with the space between the upper and lower surfaces of the manifold, the manifold coupled at its upper end to the drain plate with its lower end coupled and in fluid communication with the second lower tube.

* * * * *